United States Patent [19]

Burroughs

[11] Patent Number: 4,555,235

[45] Date of Patent: Nov. 26, 1985

[54] RETURN TOP

[76] Inventor: Robert C. Burroughs, 20400 Frederick Rd., Germantown, Md. 20874 — Lot I-2

[21] Appl. No.: 620,319

[22] Filed: Aug. 14, 1984

Related U.S. Application Data

[63] Continuation-in-part of Ser. No. 427,697, Sep. 29, 1982.

[51] Int. Cl.[4] ..... A63H 1/30; A63H 1/22

[52] U.S. Cl. ..... 446/250; 446/243; D21/99

[58] Field of Search ..... 446/236, 243, 255, 262, 446/263, 250, 251; D21/95, 94, 98, 99, 100; 40/1.6, 331; 273/280, 283, 284

[56] References Cited

U.S. PATENT DOCUMENTS

| | | | |
|---|---|---|---|
| 658,358 | 9/1900 | Ellis | 446/256 |
| 787,067 | 4/1905 | Bieder | 40/1.6 |
| 838,305 | 12/1906 | Curial | 446/243 |
| 1,220,233 | 3/1917 | Jones | 40/1.6 |
| 1,571,708 | 2/1926 | Cayo | 446/243 |
| 1,738,398 | 12/1929 | Sesti | 446/243 X |
| 1,780,256 | 11/1930 | Walss | 273/280 |
| 2,676,432 | 4/1954 | Field | 446/251 |
| 3,089,277 | 5/1963 | Reese, Jr. | 446/251 |
| 3,256,635 | 6/1966 | Radovan | 446/251 |
| 3,394,471 | 7/1968 | Holten | 273/280 X |
| 3,621,603 | 11/1971 | Gelder | 446/243 |
| 3,624,958 | 8/1970 | Salayka | 446/251 X |
| 3,953,936 | 5/1976 | Ennis | 446/250 |
| 3,961,793 | 6/1976 | Zanders | 273/6 X |
| 4,101,131 | 7/1978 | Barnby | 273/284 X |
| 4,207,701 | 6/1980 | Kuhn | 446/250 |
| 4,393,618 | 7/1983 | Ray | 446/250 X |

FOREIGN PATENT DOCUMENTS

| | | | |
|---|---|---|---|
| 3342959 | 11/1983 | Fed. Rep. of Germany | 446/250 |
| 16787 | of 1889 | United Kingdom | 446/262 |

*Primary Examiner*—Robert E. Bagwill
*Assistant Examiner*—D. Neal Muir

[57] ABSTRACT

This invention, a return top with multiple designing means enables the child to make numerous design changes in his or her return top to satisfy the creative desire or need of the individual.

18 Claims, 5 Drawing Figures

RETURN TOP

CROSS-REFERENCE TO RELATED APPLICATIONS

This invention is a Continuation-in-Part of my application filed Sept. 29, 1982, Ser. No. 427,697, Group Art Unit 331, Examiner, Mickey Yu, for a Return Top.

BACKGROUND OF THE INVENTION

1. Field of the Invention

The field of the invention lies in the category of tethered tops which represent toy tops that spin on a tethered string and return to the user's hand.

2. Description of the Prior Art

Prior art indicates Salayka, U.S. Pat. No. 3,624,958, December, 1971 as having disk members. Kuhn, U.S. Pat. No. 4,207,701, June, 1980 indicates a threaded screw portion for assembling two return top halves. Asbury, U.S. Pat. No. 1,793,151, February, 1931 indicates design portions replaceable on outside of return top. Russell, U.S. Pat. No. 3,643,373, February, 1972 has disk members.

SUMMARY OF THE INVENTION

Since all return tops basically serve the same mechanical function of spinning on a string and returning to the user's hand the most realistic difference between one return top and another apparently rests in its novelty of design. Consequently, since children are so enthusiastic about their own interpretation of what kind of design is desirable to them this invention provides the manufacturer with a means to reach the individual presence of the child rather than to look for a design that is hoped will please everyone.

This invention achieves this purpose by providing a multiple number of design inserts which fit into a recessed or cut out section on either side of the return top and secured by a decorative capped nut which mounts onto a threaded portion of the axle of said return top.

All of said design inserts except the one on the outside have apertures extending through the respective centers and are of thin wafer like material with different designs on the outer periphery of the face of either side and graduated in diameter sizes so that the design which will apear on the outer periphery of each insert comes into view once the design inserts are secured into place.

The outer design insert is of a much thicker material necessitated by its need to provide a threaded hole in its center to serve as a nut to secure the other design inserts into place, but the hole does not extend all the way through because the surface area of said outer design insert is needed to reveal a finished design.

While the outer design insert functions as a nut to secure all of the design inserts into place on a given side of the return top there is no visible indication that said outer design insert provides anything more than a finished design element once it has been secured.

This layer of design inserts provides a three dimensional design effect which can afford a multiple choice of designs by reversing the inner design inserts to reveal different designs on the reverse side or the manufacturer can further multiply the number of multiple choice designs by providing additional inner or outer design inserts as optional choices and a plurality of color schemes can enhance the options further.

There is no specific number of design inserts needed to complete the multiple designing means, but three on each side of said return top would be a practical number. Likewise, if simplicity is wished a single design insert on a given side could be utilized and optional choices provided for multiple changes.

A further object of the invention is to provide the child with means for experimentation to cater to his or her natural desire to be creative.

A further object of the invention is to provide the child with an opportunity of having his or her own design of a return top wherein the child selects design elements and color schemes.

Other objects and advantages will become apparent from a consideration of the following description and the appended claims in conjunction with the accompanying drawings wherein:

DESCRIPTION OF THE PREFERRED EMBODIMENTS

Figure 1:
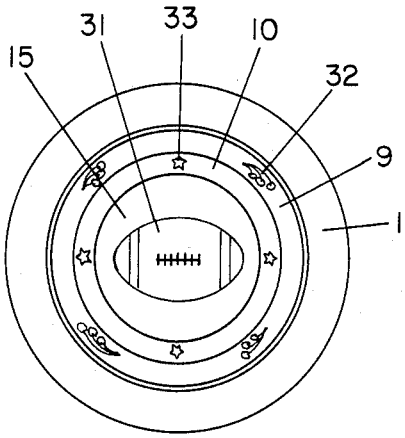
FIG. 1 is a front elevation view showing design inserts secured into place on a given side of said return top.

With continued reference to the drawings, FIG. 1 illustrates the return top 1 having design portions fastened into place on one given side of said return top.

Figure 2:
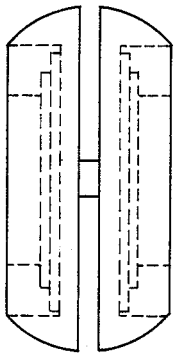
FIG. 2 is a side elevation view revealing the positions of the design inserts relative to the side elevation of said return top.

FIG. 2 reveals design portions likewise fastened into place but in a different side elevation view and fastened on both sides of said return top 1.

Figure 3:
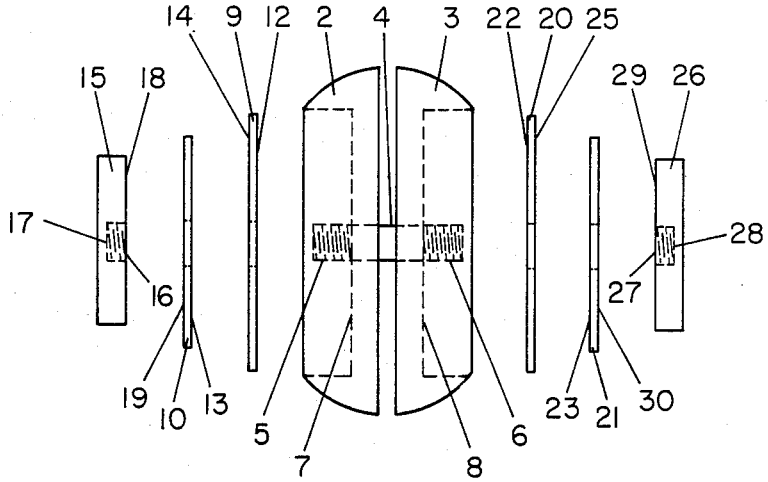
FIG. 3 is an exploded view revealing the dissembled design inserts in a perspective position for assembly.

FIG. 3 reveals the assembly and fastening means. Said return top 1 has two substantially disk shaped parts 2 and 3 joined by an axle 4 having screw threaded portions 5 and 6 at its end extremities. The two aforementioned disk shaped parts 2 and 3 have corresponding recessed areas 7 and 8 to receive design inserts.

Figure 4:
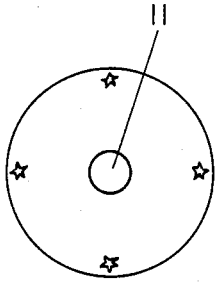
FIG. 4 is a detail view of an inner design insert and its aperture for mounting the axle of said return top.

On one given side of return top 1 design inserts 9 and 10 have clearance apertures as indicated in FIG. 4 at 11 which enable said design inserts 9 and 10 to mount the aforementioned screw threaded portion 5 of said axle 4. The surface area 12 of design insert 9 bears against the recessed area 7 of the disk shaped part 2. The surface area 13 of design insert 10 bears against the surface area 14 of design insert 9.

There is a third design insert 15 which also functions as a capped nut and has a threaded opening 16 which terminates at 17, said threaded opening corresponding with and mounting said screw threads 5 of said axle 4, the surface area 18 of said third design insert 15 bearing against the surface area 19 of said design insert 10. Said third design insert 15 tightens against the aforementioned design insert 10 which in turn tightens against design insert 9 which in turn tightens against the recess area 7, thus securing all three design inserts on disk shaped part 2.

The fastening means on the opposing side of return top 1 function in a like manner. Design inserts 20 and 21 have clearance apertures as indicated on FIG. 4 at 11 which enable said design inserts 20 and 21 to mount the screw threaded portion 6 of said axle 4. The surface area 22 of design insert 20 bears against the recessed area 8 of the disk shaped part 3. The surface area 23 of design insert 21 bears against the surface area 25 of design insert 20.

There is a third design insert 26 which also functions as a capped nut and has a threaded opening 27 which terminates at 28, said threaded opening corresponding with and mounting said screw threads 6 of axle 4, the surface area 29 of said third design insert 26 bearing against the surface area 30 of said design insert 21. Said third design insert 26 tightens against the aforementioned design insert 21 which in turn tightens against design insert 20 which in turn tighens against the recessed area 8 thus securing all three design inserts on disk shaped part 3.

FIG. 1 shows design 31 of design insert 15, design 32 of design insert 9 and design 33 of design insert 10.

Figure 5:
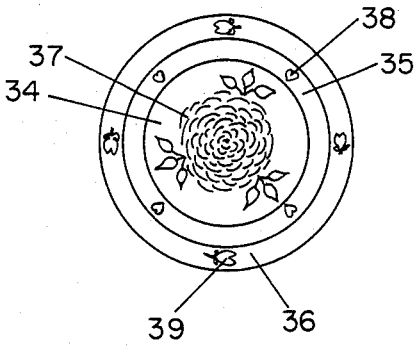
FIG. 5 is a detail view of a set of new and different design insert replacements for said return top.

FIG. 5 shows a set of replacement design inserts 34, 35 and 36. 37 indicates the design of insert 34, 38 indicates the design of insert 35 and 39 indicates the design of insert 36.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A return top having a multiple designing means mounted to a structure and rotating with the speed of said structure, said structure comprising a pair of substantially disk shaped parts and an axle connecting said pair of substantially disk shaped parts, said multiple designing means comprising stacked and removable design washers of said pair of substantially disk shaped parts, there being at least two of said stacked and removable design washers for each side, each with different overall diameters, each having apertures extending therethrough to mount to said axle with different designs on opposing faces of said design relates enabling a changing and replacing of face side up designs of said design washers by the reversing of said design washers, said designs on face side up of said design washers being visible when stacked, said design washers independent of one another, said design washers secured with fastening means, said fastening means comprising at least one screw threaded portion and at least one correspondingly threaded nut, said fastening means enabling the removal and replacing and repositioning of said design washers upon removal of said threaded nut.

2. A return top having a multiple designing means as described in claim 1, there being at least one of said substantially disk shaped parts having a recessed area to receive said removable design washers.

3. A return top having a multiple designing means as described in claim 1, said fastening means having a design portion, said fastening means being removable and replaceable and repositionable.

4. A return top having a multiple designing means as described in claim 2, said fastening means having a design portion, said fastening means being removable and replaceable and repositionable.

5. A return top having a multiple designing means enabling a changing and replacing and repositioning of surface designs of said multiple designing means with the use of existing mounted parts without changing its geometrical structure, and means to revert said return top back to its original surface design with same said existing mounted parts, said multiple designing means mounted to a structure, said structure comprising a pair of substantially disk shaped parts and an axle connecting said pair of substantially disk shaped parts, said multiple designing means comprising stacked and removable and repositionable design dates of said pair of substantially disk shaped parts, there being at least two of said stacked and removable design washers associated with each said disk shaped part, each plate having separate designs on opposing faces enabling a changing and replacing and repositioning of face side up designs of said design washers by the reversing of said design washers said designs on face side up of said design washers being visible when stacked, said design washers secured with fastening means, said fastening means enabling the removal and replacing and repositioning of said design washers.

6. A return top having a multiple designing means as described in claim 5, there being at least one of said substantially disk shaped parts having a recessed area to receive said removable design washers.

7. A return top having a multiple designing means as described in claim 5, said fastening means comprising at least one screw threaded portion and at least one correspondingly threaded nut, said stacked and removable design washers having apertures extending therethrough to mount said screw threaded portion.

8. A return top having a multiple designing means as described in claim 6, said fastening means comprising at least one screw threaded portion and at least one correspondingly threaded nut, said stacked and removable design washers having apertures extending therethrough to mount said screw threaded portion.

9. A return top having a multiple designing means as described in claim 5, said fastening means having a design portion, said fastening means being removable and replaceable and repositionable.

10. A return top having a multiple designing means as described in claim 6, said fastening means having a design portion, said fastening means being removable and replaceable and respositionable.

11. A return top having a multiple designing means as described in claim 7, said fastening means having a design portion, said fastening means being removable and replaceable and repositionable.

12. A return top having a multiple designing means as described in claim 8, said fastening means having a design portion, said fastening means being removable and replaceable and repositionable.

13. A return top having a multiple designing means as described in claim 5, said design portions functioning independently of one another.

14. A return top having a multiple designing means as described in claim 6, said design portions functioning independently of one another,

15. A return top having a multiple designing means as described in claim 7, said design portions functioning independently of one another.

16. A return top having a multiple designing means as described in claim 8, said design portions functioning independently of one another.

17. A return top having a multiple designing means as described in claim 9, said design portions functioning independently of one another.

18. A return top having a multiple designing means as described in claim 12, said design portions functioning independently of one another.

* * * * *

UNITED STATES PATENT AND TRADEMARK OFFICE

CERTIFICATE OF CORRECTION

PATENT NO. : 4,555,235

DATED : November 26, 1985

INVENTOR(S) : Robert C. Burroughs

It is certified that error appears in the above-identified patent and that said Letters Patent is hereby corrected as shown below:

Column 1, line 33, "presence" should read -- preference --.

Column 2, line 25, "dissembled" should read -- disassembled --.

Column 3, line 12, "tighens" should read -- tightens --.

Column 4, Claim 5, line 7, "dates" shouod read -- washers --.

Signed and Sealed this

*Fourth* Day of *March 1986*

[SEAL]

*Attest:*

DONALD J. QUIGG

*Attesting Officer*

*Commissioner of Patents and Trademarks*